US009885993B2

(12) United States Patent
Hara

(10) Patent No.: US 9,885,993 B2
(45) Date of Patent: Feb. 6, 2018

(54) PRINTER

(71) Applicant: RISO KAGAKU CORPORATION, Tokyo (JP)

(72) Inventor: Masashi Hara, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/067,761

(22) Filed: Mar. 11, 2016

(65) Prior Publication Data

US 2016/0274525 A1 Sep. 22, 2016

(30) Foreign Application Priority Data

Mar. 20, 2015 (JP) ..... 2015-057990

(51) Int. Cl.

| | |
|---|---|
| ***G03G 15/00*** | (2006.01) |
| ***B41J 2/01*** | (2006.01) |
| ***B41J 11/00*** | (2006.01) |
| ***B41J 11/20*** | (2006.01) |
| ***B41J 13/00*** | (2006.01) |

(52) U.S. Cl.

CPC ..... *G03G 15/70* (2013.01); *B41J 2/01* (2013.01); *B41J 11/006* (2013.01); *B41J 11/20* (2013.01); *B41J 13/009* (2013.01)

(58) Field of Classification Search

CPC ..... G06K 15/4085; G06K 15/16; G06K 2215/0085; G06K 2215/101; B65H 29/56; B65H 5/062; B41J 2/01; B41J 11/006; B41J 11/20; B41J 13/009; G03G 15/70

See application file for complete search history.

(56) References Cited

U.S. PATENT DOCUMENTS 5,448,348 A * 9/1995 Azeta ..... G03G 15/231 271/291
2006/0256354 A1* 11/2006 Nakamura ..... B41J 11/0095 358/1.1

(Continued)

FOREIGN PATENT DOCUMENTS

JP 2002137849 A * 5/2002
JP 2010-131859 6/2010

OTHER PUBLICATIONS

U.S. Appl. No. 14/968,015 to Hara et al., filed Dec. 14, 2015.
U.S. Appl. No. 15/067,801 to Hara , filed Mar. 11, 2016.

*Primary Examiner* — David Banh
(74) *Attorney, Agent, or Firm* — Greenblum & Bernstein, P.L.C.

(57) ABSTRACT

Upon occurrence of a paper jam on a main conveying route, a controller performs control of stopping paper conveyance at a section of the main conveying route upstream of a position of the paper jam in a conveying direction and discharging sheets at a section of the main conveying route downstream of the position of the paper jam in the conveying direction, and performs control of stopping paper conveyance at a circulation conveying route. Upon occurrence of a paper jam on the circulation conveying route, a controller performs control of stopping paper conveyance at a section of the circulation conveying route upstream of a position of the paper jam, and performs control of discharging sheets at a section of the circulation conveying route downstream of the position of the paper jam and at the main conveying route.

6 Claims, 5 Drawing Sheets

(56) References Cited

U.S. PATENT DOCUMENTS

| | | | | |
|---|---|---|---|---|
| 2010/0086338 | A1* | 4/2010 | Hara | G03G 15/6561 399/406 |
| 2010/0119244 | A1* | 5/2010 | Kitagawa | G03G 15/2064 399/21 |
| 2013/0181394 | A1* | 7/2013 | Ogata | B41J 3/60 271/225 |

* cited by examiner

PRINTER

CROSS REFERENCE TO RELATED APPLICATION

This application is based upon and claims the benefit of priority from the prior Japanese Patent Application No. 2015-057990, filed on Mar. 20, 2015, the entire contents of which are incorporated herein by reference.

BACKGROUND

1. Technical Field

The disclosure relates to a printer for printing sheets.

2. Related Art

Japanese Unexamined Patent Application Publication No. 2010-131859 proposes a printer which performs printing by simultaneously conveying a plurality of sheets on a conveying route.

When a paper jam occurs in this printer, the paper conveyance stops. Thus, the sheets that are being conveyed at the time of occurrence of the paper jam remain inside the machine. The sheets remaining inside the machine are removed by the user through jam releasing work.

SUMMARY

In the case of the above printer, when the paper conveyance stops due to the occurrence of a paper jam, many sheets may remain inside the machine. Thus, the work of removing the remaining sheets may force a great burden on the user.

An object of the disclosure is to provide a printer capable of reducing the amount of paper jam releasing work.

A printer in accordance with some embodiments includes: a main conveyer including a paper feeder configured to feed a sheet in a conveying direction, a printing conveyer provided downstream of the paper feeder in the conveying direction and configured to convey the sheet in the conveying direction, an image former configured to form an image on the sheet being conveyed by the printing conveyer, and a paper discharger provided downstream of the printing conveyer in the conveying direction and configured to discharge the sheet, the main conveyer being configured to convey the sheet along a main conveying route extending from the paper feeder through the printing conveyer to the paper discharger; a circulation conveyer configured to convey the sheet along a circulation conveying route branched off from the main conveying route at a branch point between the printing conveyer and the paper discharger and joining the main conveying route at a point upstream of the printing conveyer in the conveying direction; and a controller configured to control the main conveyer and the circulation conveyer. Upon occurrence of a paper jam on the main conveying route, the controller drives the main conveyer and the paper discharger to stop paper conveyance at a section of the main conveying route upstream of a position of the paper jam in the conveying direction and to discharge sheets at a section of the main conveying route downstream of the position of the paper jam in the conveying direction, and drives the circulation conveyer to stop paper conveyance at the circulation conveying route. Upon occurrence of a paper jam on the circulation conveying route, the controller drives the circulation conveyer to stop paper conveyance at a section of the circulation conveying route upstream of a position of the paper jam, and drives the circulation conveyer, the main conveyer, and the paper discharger to discharge sheets at a section of the circulation conveying route downstream of the position of the paper jam and at the main conveying route.

In the configuration described above, the sheets remaining after the occurrence of a paper jam can be reduced. As a result, the amount of paper jam releasing work can be reduced.

When stopping the paper conveyance at the section of the circulation conveying route upstream of the position of the paper jam upon occurrence of the paper jam on the circulation conveying route, the controller may drive the circulation conveyer to stop the sheets with an interval between the sheets shorter than an interval between sheets during normal conveyance.

In the configuration described above, the range within which the remaining sheets spread can be narrowed. As a result, the amount of paper jam releasing work can be reduced further.

The printer may further include: a first sheet sensor arranged along the main conveying route; and a second sheet sensor arranged along the circulation conveying route. The controller may drive the circulation conveyer to convey sheets at the circulation conveying route with an interval between the sheets longer than an interval between sheets at a section of the main conveying route upstream of the branch point in the conveying direction, and determine an occurrence of a paper jam in at least one of a case where a delay time of a timing of sheet detection by the first sheet sensor from a theoretical value for the timing of sheet detection by the first sheet sensor is greater than or equal to a first jam determining threshold value or a case where a delay time of a timing of sheet detection by the second sheet sensor from a theoretical value for the timing of sheet detection by the second sheet sensor is greater than or equal to a second jam determining threshold value. The second jam determining threshold value may be greater than the first jam determining threshold value.

In the configuration described above, when a paper jam occurs on the switchback circulation route, it is possible to lengthen the time for which the paper conveyance can be continued. As a result, it is possible to shorten the down time due to the occurrence of the paper jam.

DETAILED DESCRIPTION

Figure 1:
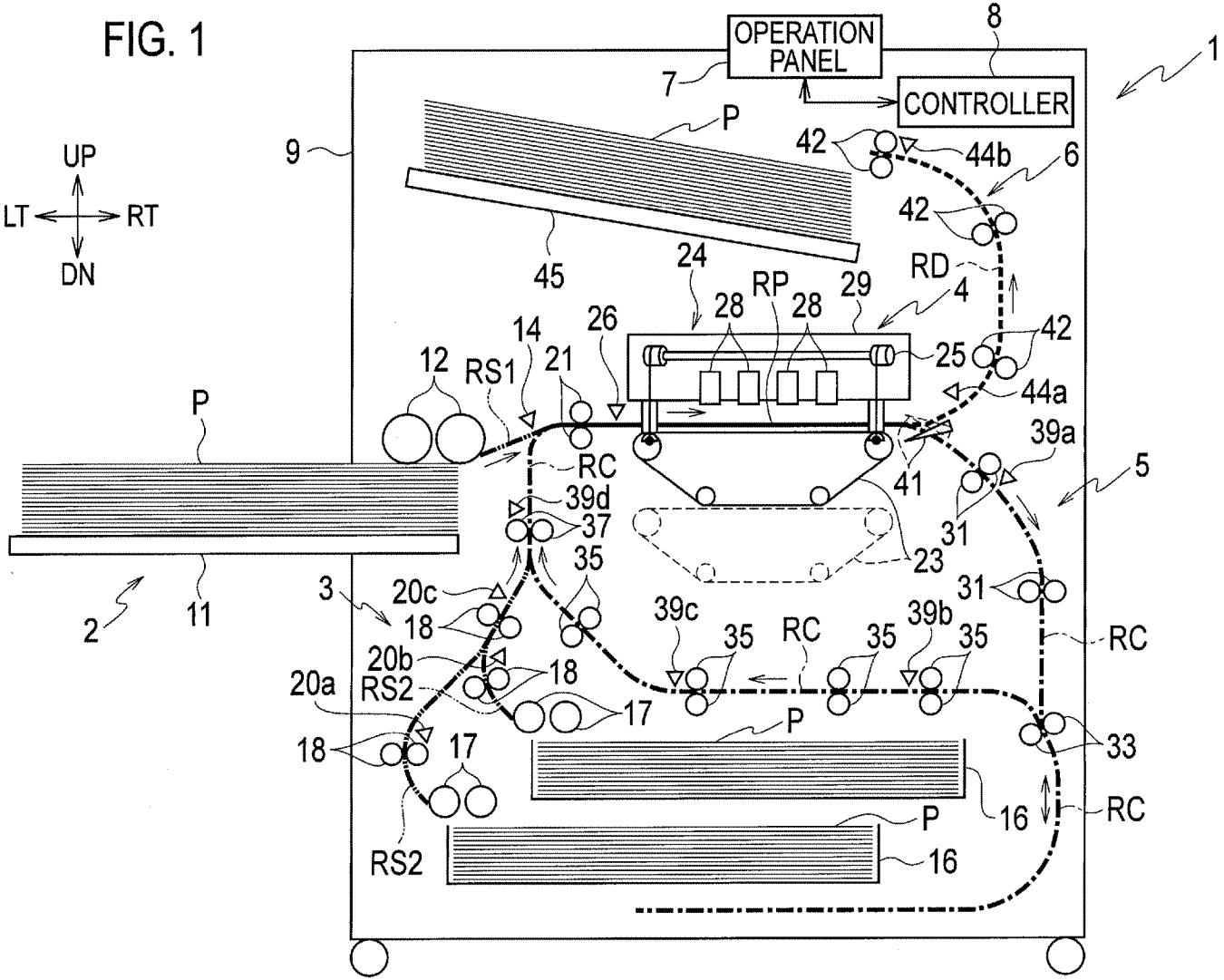
FIG. 1 is a schematic configuration diagram of a printer in an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
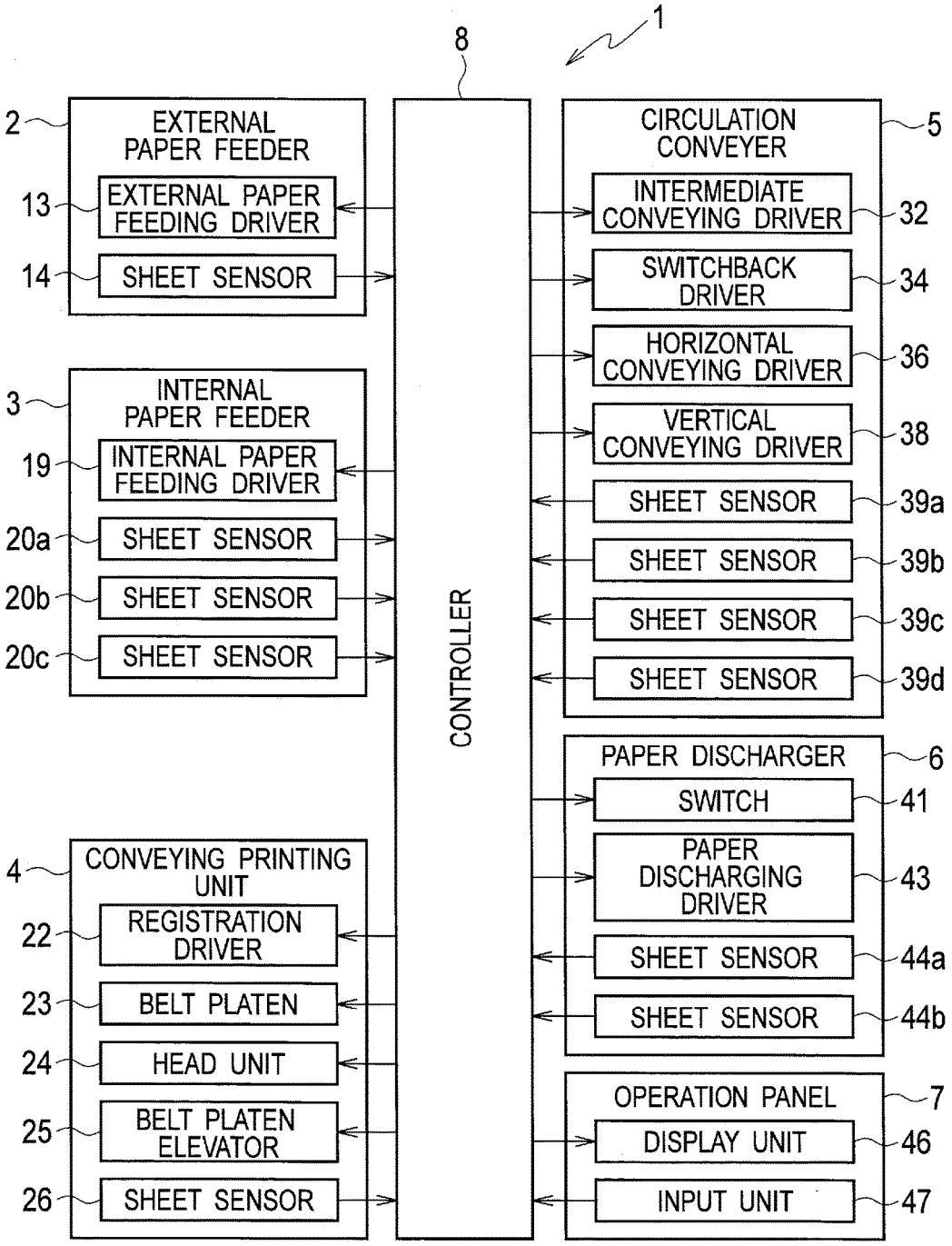
FIG. 2 is a control block diagram of the printer illustrated in FIG. 1.

FIG. 1 is a schematic configuration diagram of a printer 1 in an embodiment. FIG. 2 is a control block diagram of the printer 1 illustrated in FIG. 1. In the following description, the direction perpendicular to the plane of the sheet of FIG. 1 is the front-rear direction, and the foreside of the plane of the sheet is the front side. Also, in FIG. 1 and FIGS. 4 to 7, the directions of right, left, up, and down are denoted by RT, LT, UP, and DN, respectively.

Routes illustrated by bold lines in FIG. 1 are conveying routes through which sheets P being print media are conveyed. Of these conveying routes, a route illustrated by a solid line is a printing route RP, a route illustrated by a one-dot chain line is a switchback circulation route RC, a route illustrated by a broken line is a paper discharging route RD, and routes illustrated by two-dot chain lines are an external paper feeding route RS1 and an internal paper feeding route RS2. In the following description, upstream and downstream mean upstream and downstream in the conveying route.

As illustrated in FIGS. 1 and 2, the printer 1 includes an external paper feeder 2, an internal paper feeder 3, a conveyance printing unit 4, a circulation conveyer 5, a paper discharger 6, an operation panel 7, a controller 8, and a case 9 configured to house or hold these components.

The external paper feeder 2 is configured to feed sheets P loaded in such a way as to be exposed partly to the outside of the case 9. The external paper feeder 2 includes an external paper feed tray 11, external paper feeding rollers 12, an external paper feeding driver 13, and a sheet sensor 14.

The external paper feed tray 11 is a component on which to load sheets P to be used for printing. The external paper feed tray 11 is placed in such a way as to be exposed partly to the outside of the case 9.

The external paper feeding rollers 12 are configured to pick up the sheets P loaded on the external paper feed tray 11 one by one and convey each sheet P toward registration rollers 21 to be described later along the external paper feeding route RS1.

The external paper feeding driver 13 is configured to rotationally drive the external paper feeding rollers 12. The external paper feeding driver 13 includes a motor.

The sheet sensor 14 is configured to detect the sheet P conveyed along the external paper feeding route RS1. The sheet sensor 14 is also configured to detect a sheet P conveyed along the switchback circulation route RC from vertical conveying rollers 37 to be described later to the registration rollers 21. The sheet sensor 14 is arranged on a downstream end section of the external paper feeding route RS1.

The internal paper feeder 3 is configured to feed sheets P loaded inside the case 9. The internal paper feeder 3 includes two internal paper feed trays 16, two pairs of internal paper feeding rollers 17, three pairs of internal paper feeding conveying rollers 18, an internal paper feeding driver 19, and sheet sensors 20*a* to 20*c*.

The internal paper feed trays 16 are components on which to load sheets P to be used for printing. The internal paper feed trays 16 are arranged inside the case 9.

The internal paper feeding rollers 17 are configured to pick up the sheets P loaded on the internal paper feed trays 16 one by one and convey them along the internal paper feeding route RS2.

The internal paper feeding conveying rollers 18 are configured to convey each of the sheets P picked up by the internal paper feeding rollers 17 from the internal paper feed trays 16 toward the later-described vertical conveying rollers 37. The internal paper feeding conveying rollers 18 are arranged along the internal paper feeding route RS2. The internal paper feeding route RS2 has its downstream end connected to the switchback circulation route RC between the most downstream ones of horizontal conveying rollers 35 to be described later and the vertical conveying rollers 37.

The internal paper feeding driver 19 is configured to rotationally drive the internal paper feeding rollers 17 and the internal paper feeding conveying rollers 18. The internal paper feeding driver 19 includes a plurality of motors.

The sheet sensors 20*a* to 20*c* are configured to detect the sheets P conveyed along the internal paper feeding route RS2. The sheet sensors 20*a* to 20*c* are arranged downstream of and near the three pairs of internal paper feeding conveying rollers 18, respectively.

The conveyance printing unit 4 is configured to print an image on a sheet P while conveying the sheet P. The conveyance printing unit 4 includes the registration rollers 21, a registration driver 22, a belt platen (printing conveyer) 23, a head unit (image former) 24, a belt platen elevator 25, and a sheet sensor 26.

The registration rollers 21 are configured to convey the sheet P conveyed from the external paper feeding rollers 12 or the vertical conveying rollers 37 to the belt platen 23. The registration rollers 21 are arranged on the printing route RP downstream of and near the point at which the external paper feeding route RS1 and the switchback circulation route RC join.

The registration driver 22 is configured to rotationally drive the registration rollers 21. The registration driver 22 includes a motor.

The belt platen 23 is configured to convey the sheet P conveyed by the registration rollers 21 along the printing route RP while attracting and holding the sheet P to and on its belt. Inkjet heads 28 to be described later eject inks onto the sheet P while the sheet P is being conveyed by the belt platen 23, thereby printing an image on the sheet P. In other words, the belt platen 23 conveys the sheet P while the sheet P is being printed. The belt platen 23 is arranged downstream of the registration rollers 21.

The belt platen 23 can be raised and lowered between a print position and a retreat position by the belt platen elevator 25. The print position is the position of the belt platen 23 at which printing is performed. The print position is the position of the belt platen 23 illustrated in FIG. 1 by a solid line and is near the lower side of the head unit 24. The retreat position is the position of the belt platen 23 to which it is retreated downward from the print position. The retreat position is the position of the belt platen 23 illustrated in FIG. 1 by a broken line.

The head unit 24 is configured to print an image on the sheet P conveyed by the belt platen 23 by ejecting inks onto the sheet P. The head unit 24 includes the plurality of inkjet heads 28 and a head holder 29.

Each inkjet head 28 includes a plurality of nozzles arranged along the front-rear direction (main scanning direction) and is configured to eject an ink through the nozzles. The plurality of inkjet heads 28 are arranged side by side along the direction of conveyance of the sheet P by the belt platen 23 (left-right direction).

The head holder 29 is configured to hold the inkjet heads 28. The head holder 29 is fixed to a predetermined position inside the case 9.

The belt platen elevator 25 is configured to raise and lower the belt platen 23. The belt platen elevator 25 is arranged inside the head holder 29. The belt platen elevator 25 includes wires, pulleys, a motor, and the like and supports the belt platen 23 in a hanging manner with the wires. The belt platen elevator 25 raises and lowers the belt platen 23 by reeling in and out the wires via rotation of the pulleys with the motor.

The sheet sensor 26 is configured to detect the sheet P conveyed along the printing route RP from the registration rollers 21 to the belt platen 23. The sheet sensor 26 is arranged between the registration rollers 21 and the upstream end of the belt platen 23.

The circulation conveyer 5 is configured to, in duplex printing, convey a sheet P printed on one side along the switchback circulation route RC from the downstream end of the belt platen 23 through under the belt platen 23 to the registration rollers 21. The circulation conveyer 5 includes two pairs of intermediate conveying rollers 31, an intermediate conveying driver 32, switchback rollers 33, a switchback driver 34, four pairs of horizontal conveying rollers 35, a horizontal conveying driver 36, the vertical conveying rollers 37, a vertical conveying driver 38, and sheet sensors 39*a* to 39*d*.

The intermediate conveying rollers 31 are configured to, in duplex printing, convey the sheet P printed on one side and guided to the switchback circulation route RC by a switch 41 to be described later to the switchback rollers 33. The two pairs of intermediate conveying rollers 31 are arranged along a downward section of the switchback circulation route RC between the belt platen 23 and the switchback rollers 33.

The intermediate conveying driver 32 is configured to rotationally drive the intermediate conveying rollers 31. The intermediate conveying driver 32 includes a motor.

The switchback rollers 33 are configured to cause the sheet P conveyed by the intermediate conveying rollers 31 to switchback, so that the sheet P is turned upside down. The switchback rollers 33 are arranged along the switchback circulation route RC downstream of the intermediate conveying rollers 31.

The switchback driver 34 is configured to rotationally drive the switchback rollers 33. The switchback driver 34 includes a motor.

The horizontal conveying rollers 35 are configured to convey the sheet P under the belt platen 23 to the vertical conveying rollers 37 after the sheet P is caused to switchback by the switchback rollers 33. The three upstream pairs of horizontal conveying rollers 35 are arranged along a horizontal section of the switchback circulation route RC under the belt platen 23. The most downstream pair of horizontal conveying rollers 35 are arranged along an upward section of the switchback circulation route RC downstream of the horizontal section.

The horizontal conveying driver 36 is configured to rotationally drive the horizontal conveying rollers 35. The horizontal conveying driver 36 includes a plurality of motors.

The vertical conveying rollers 37 are configured to, in duplex printing, convey the sheet P printed on one side and conveyed by the horizontal conveying rollers 35, to the registration rollers 21. The vertical conveying rollers 37 are also configured to convey each unprinted sheet P fed by the internal paper feeder 3 to the registration rollers 21. The vertical conveying rollers 37 are arranged along a vertical section in a downstream region of the switchback circulation route RC.

The vertical conveying driver 38 is configured to rotationally drive the vertical conveying rollers 37. The vertical conveying driver 38 includes a motor.

The sheet sensors 39*a* to 39*d* are configured to detect the sheet P conveyed along the switchback circulation route RC. The sheet sensor 39*a* is arranged downstream of and near the upstream intermediate conveying rollers 31. The sheet sensor 39*b* is arranged downstream of and near the most upstream horizontal conveying rollers 35. The sheet sensor 39*c* is arranged downstream of and near the third horizontal conveying rollers 35 from the upstream side. The sheet sensor 39*d* is arranged downstream of and near the vertical conveying rollers 37.

The paper discharger 6 is configured to discharge each printed sheet P. The paper discharger 6 is arranged downstream of the belt platen 23. The paper discharger 6 includes the switch 41, three pairs of paper discharging rollers 42, a paper discharging driver 43, sheet sensors 44*a*, 44*b*, and a paper receiving tray 45.

The switch 41 is configured to switch the destination of conveyance of the sheet P from the belt platen 23 between the paper discharging route RD and the switchback circulation route RC. The switch 41 is arranged at a point (branch point) which is the downstream end of the printing route RP and the upstream ends of the switchback circulation route RC and the paper discharging route RD.

The switch 41 is capable of switching its direction between a paper discharge guiding direction and a circulation guiding direction. The paper discharge guiding direction is a direction in which the sheet is guided from the belt platen 23 to the paper discharging route RD. The paper discharge guiding direction is the direction of the switch 41 illustrated in FIG. 1 by a solid line. The circulation guiding direction is a direction in which the sheet is guided from the belt platen 23 to the switchback circulation route RC. The circulation guiding direction is the direction of the switch 41 illustrated in FIG. 1 by a broken line.

The paper discharging rollers 42 are configured to receive the sheet P conveyed from the belt platen 23 and discharge it onto the paper receiving tray 45. The paper discharging rollers 42 are arranged along the paper discharging route RD, which extends from the downstream end of the printing route RP.

The paper discharging driver 43 is configured to rotationally drive the paper discharging rollers 42. The paper discharging driver 43 includes a motor.

The sheet sensors 44*a*, 44*b* are configured to detect the sheet P conveyed along the paper discharging route RD. The sheet sensor 44*a* is arranged along the paper discharging route RD upstream of the most upstream paper discharging rollers 42. The sheet sensor 44*b* is arranged near and upstream of the most downstream paper discharging rollers 42.

The paper receiving tray 45 is a component on which to load the sheet P discharged by the paper discharging rollers 42. The paper receiving tray 45 is arranged at the downstream end of the paper discharging route RD.

The operation panel 7 is configured to display various input windows and the like and receive input operations from the user. The operation panel 7 includes a display unit 46 and an input unit 47.

The display unit 46 is configured to display the various input windows and the like. The display unit 46 includes a liquid crystal display panel and the like.

The input unit 47 is configured to receive input operations from the user and output operation signals corresponding to the operations. The input unit 47 includes various operation keys, a touchscreen, and the like.

The controller 8 is configured to control the operation of given components of the printer 1. The controller 8 includes a CPU, a RAM, a ROM, a hard disk drive, and the like as its constituent components.

In performing printing operation, the controller 8 performs control to feed a sheet P with the external paper feeder 2 or the internal paper feeder 3 and print the sheet P while conveying the sheet P with the conveyance printing unit 4. In the case of duplex printing, the controller 8 performs control to turn upside down the sheet P printed on one side and convey it to the conveyance printing unit 4 with the circulation conveyer 5 and then print its unprinted side. The controller 8 performs control to discharge the printed sheet P with the paper discharger 6.

During the printing operation, the controller 8 determines whether or not a paper jam has occurred, based on the timings of sheet detection by the sheet sensors 14, 20*a* to 20*c*, 26, 39*a* to 39*d*, 44*a*, 44*b*. The controller 8 executes a paper jam handling process to be described layer if determining that a paper jam has occurred.

Next, the operation of the printer 1 will be described.

Upon input of a print job, the controller 8 executes printing operation. The controller 8 acquires simplex/duplex printing setting information contained in the print job and executes simplex printing or duplex printing in accordance with the content of this information.

The following assumes that sheets are fed from the external paper feeder 2 during the printing operation. In this case, the external paper feeder 2 corresponds to a paper feeder that feeds sheets. Also, a route formed of the external paper feeding route RS1, the printing route RP, and the paper discharging route RD corresponds to a main conveying route. In the following, the route formed of the external paper feeding route RS1, the printing route RP, and the paper discharging route RD will be referred to as the main conveying route when appropriate. Further, the external paper feeder 2, the conveyance printing unit 4, and the paper discharger 6 constitute a main conveyer. Furthermore, the switchback circulation route RC, which is a route branched off from the main conveying route between the belt platen 23 and the paper discharger 6 and joining the main conveying route upstream of the belt platen 23, corresponds to a circulation conveying route.

First, the simplex printing will be described. Upon start of simplex printing operation, the controller 8 performs control to sequentially feed unprinted sheets P from the external paper feeder 2 to the conveyance printing unit 4. The controller 8 controls the external paper feeder 2 and the registration rollers 21 to sequentially send the sheets P onto the belt platen 23 at such timings that the sheets P are conveyed on the belt platen 23 with a predetermined sheet interval therebetween shorter than the length of a sheet. The sheet interval is the interval between the trailing end of a preceding sheet P and the leading end of the following sheet P.

Each sheet P sent onto the belt platen 23 is printed with the inks ejected from the inkjet heads 28 while being conveyed by the belt platen 23 at a predetermined printing conveying speed. The printed sheet P is guided from the printing route RP to the paper discharging route RD by the switch 41 oriented in the paper discharge guiding direction. At the paper discharger 6, the sheet P guided to the paper discharging route RD is conveyed by the paper discharging rollers 42 and discharged onto the paper receiving tray 45.

Next, the duplex printing will be described. In the duplex printing, the controller 8 controls the external paper feeder 2 to sequentially feed unprinted sheets P at such timings that the length of time between the timings of feed of two sheets P can be twice longer than that in the simplex printing. As a result, in the duplex printing, the interval between the timings at which two sheets to reach the registration rollers 21 is twice longer than that in the simplex printing.

Each unprinted sheet P sent onto the belt platen 23 by the registration rollers 21 is printed while being conveyed by the belt platen 23. The sheet P printed on one side is guided from the printing route RP to the switchback circulation route RC by the switch 41 oriented in the circulation guiding direction, and then conveyed to the switchback rollers 33 by the intermediate conveying rollers 31. The sheet P is caused to switchback by the switchback—rollers 33. Thereafter, the sheet P is conveyed to the registration rollers 21 by the horizontal conveying rollers 35 and the vertical conveying rollers 37. The sheet P is then sent onto the belt platen 23 by the registration rollers 21 again.

Here, the sheet P printed on one side is conveyed to the registration rollers 21 at such a timing that the sheet P printed on one side and sequentially fed unprinted sheets P are sent alternately onto the belt platen 23. As mentioned above, in the duplex printing, the interval between the timings at which two sheets sequentially fed from the external paper feeder 2 reach the registration rollers 21 is twice longer than that in the simplex printing. Hence, the sheet P printed on one side can be introduced between unprinted sheets P and sent onto the belt platen 23 alternately with the feed of the unprinted sheets P.

The sheet P printed on one side is sent onto the belt platen 23 with its unprinted side facing up since the sheet P has been caused to switchback by the switchback rollers 33. The sheet P printed on one side is printed on the unprinted side while being conveyed by the belt platen 23. The sheet P printed on both sides is then guided from the printing route RP to the paper discharging route RD by the switch 41 oriented in the paper discharge guiding direction, conveyed by the paper discharging rollers 42, and discharged onto the paper receiving tray 45.

As described above, in the duplex printing, a sheet P printed on one side is sent onto the belt platen 23 alternately with the feed of unprinted sheets P, so that the printing of one side of the unprinted sheets P and the printing of the unprinted side of the sheet P printed on one side are performed alternately on the belt platen 23. In this way, the duplex printing is performed with the same productivity per side as the simplex printing.

During this duplex printing, the controller 8 controls the switch 41 to switch its direction alternately between the circulation guiding direction and the paper discharge guiding direction. As a result, of the sheets P conveyed from the belt platen 23 to the switch 41, the sheet P printed on one side is guided to the circulation conveyer 5 whereas the sheet P printed on both sides is guided to the paper discharger 6. The controller 8 switches the direction of the switch 41 based on a theoretical value of the timing at which the trailing end of a sheet P exits the switch 41. The switching of the direction of the switch 41 is done within a period after the trailing end of a sheet P passes the switch 41 but before the leading end of the next sheet P reaches the switch 41.

Since every other sheet P reaching the switch 41 from the belt platen 23 is guided to the circulation conveyer 5, the sheets P are conveyed with one sheet absent therebetween at the circulation conveyer 5. Thus, on the switchback circulation route RC, the sheets P are conveyed with an interval therebetween longer than the interval between the sheets P on the printing route RP. Specifically, on the switchback circulation route RC, the sheets P are conveyed with an interval therebetween which is the sum of the double of the predetermined sheet interval and the length of a sheet.

During the simplex printing or duplex printing operation described above, the controller 8 determines whether or not a paper jam has occurred. Specifically, the controller 8 determines that a paper jam has occurred, if the delay time of the timing of detection of a sheet P by any of the sheet sensors 14, 26, 39*a* to 39*d*, 44*a*, 44*b* from the corresponding theoretical value is greater than or equal to a jam determining threshold value.

Here, the jam determining threshold value is greater for the main conveying route (external paper feeding route RS1, printing route RP, and paper discharging route RD) than for the switchback circulation route RC. Specifically, the jam determining threshold value for the main conveying route is the amount of time required to convey a sheet by the predetermined sheet interval. The jam determining threshold value for the switchback circulation route RC is the sum of the amount of time required to convey a sheet by the predetermined sheet interval and the amount of time required to convey a sheet by the length of a sheet.

Figure 3:
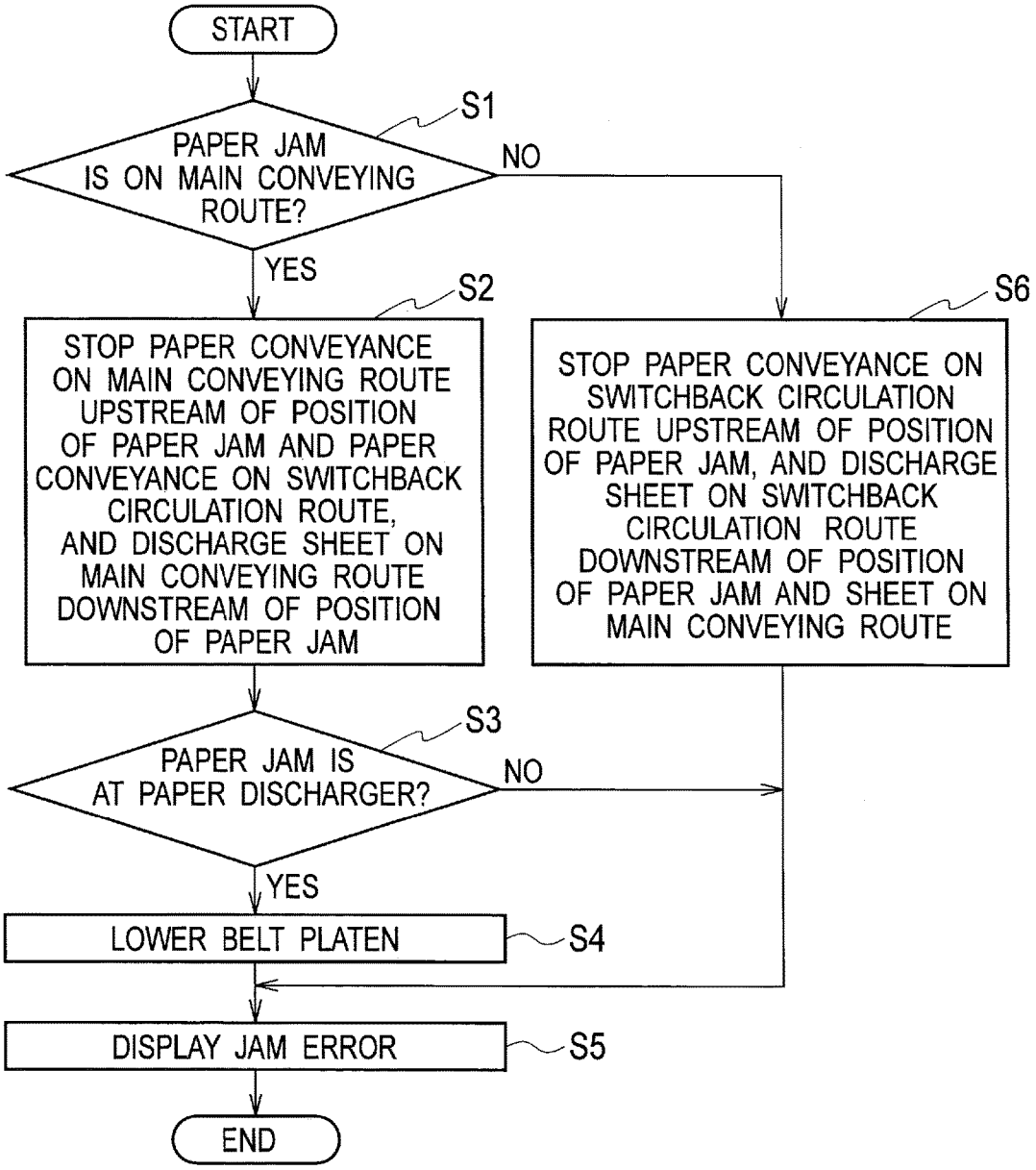
FIG. 3 is a flowchart of a paper jam handling process.

If determining that a paper jam has occurred, the controller 8 executes the paper jam handling process. This paper jam handling process will now be described. FIG. 3 is a flowchart of the paper jam handling process. The process in the flowchart in FIG. 3 starts when it is determined that a paper jam has occurred.

In Step S1 in FIG. 3, the controller 8 determines whether or not the occurred paper jam is a paper jam on the main conveying route (external paper feeding route RS1, printing route RP, and paper discharging route RD). Here, the controller 8 determines that the occurred paper jam is a paper jam on the main conveying route, if the sheet sensor 14 detects a jam of a sheet P conveyed by the external paper feeding rollers 12 or if any of the sheet sensors 26, 44*a*, 44*b* detects a paper jam.

If determining that the occurred paper jam is a paper jam on the main conveying route (Step S1: YES), the controller 8 in Step S2 performs control to stop the paper conveyance on the main conveying route upstream of the position of the paper jam and the paper conveyance on the switchback circulation route RC. Also, the controller 8 performs control to discharge the sheets P on the main conveying route downstream of the position of the paper jam. Note that, in the case of the simplex printing, sheets P are not present on the switchback circulation route RC and therefore the control to stop the paper conveyance on the switchback circulation route RC is not required.

When stopping the paper conveyance on the switchback circulation route RC, the controller 8 controls the circulation conveyer 5 such that the sheets P are stopped with an interval therebetween shorter than that during the normal conveyance, during which no jam is present. Specifically, the controller 8 controls the circulation conveyer 5 such that the sheets P are stopped with the predetermined sheet interval therebetween.

Here, in a case where the direction of the switch 41 is the circulation guiding direction at the time of detection of a paper jam on the main conveying route by the sheet sensor 14 or the sheet sensor 26, the controller 8 switches the switch 41 to the paper discharge guiding direction once the trailing end of the sheet P passing the switch 41 at the time of detection of the paper jam exits the switch 41. As a result, the sheets P downstream of the sheet sensor 14 or the sheet sensor 26, which is the position of the paper jam, can be discharged.

In Step S3 after Step S2, the controller 8 determines whether or not the occurred paper jam is a paper jam at the paper discharger 6. Here, the controller 8 determines that the occurred paper jam is a paper jam at the paper discharger 6, if the paper jam is detected by the sheet sensor 44*a*, 44*b*.

If determining that the occurred paper jam is a paper jam at the paper discharger 6 (Step S3: YES), the controller 8 lowers the belt platen 23 to the retreat position in Step S4.

Here, if the occurred paper jam is a paper jam at the paper discharger 6, the conveyance of the sheets P upstream of the position of the paper jam is stopped, so that sheets P remain at the belt platen 23. With the belt platen 23 at the print position, there is hardly a space between the head unit 24 and the belt platen 23 for the user to insert his or her hand and it is therefore difficult to remove the remaining sheets on the belt platen 23. For this reason, the belt platen 23 is lowered to the retreat position to leave a work space between the belt platen 23 and the head unit 24 for removing the remaining sheets from the belt platen 23.

After Step S4, the controller 8 proceeds to Step S5. Meanwhile, if determining in Step S3 that the occurred paper jam is not a paper jam at the paper discharger 6 (Step S3: NO), the controller 8 skips Step S4 and proceeds to Step S5.

In Step S5, the controller 8 displays the jam error. Specifically, the controller 8 causes the display unit 46 to display a jam error window which notifies the user of the occurrence of the paper jam and prompts the user to perform paper jam releasing work. By this step, the paper jam handling process ends.

If determining in Step S1 that the occurred paper jam is a paper jam on the switchback circulation route RC (Step S1: NO), the controller 8 proceeds to Step S6. Here, the controller 8 determines that the occurred paper jam is a paper jam on the switchback circulation route RC, if the paper jam is detected by any of the sheet sensors 39*a* to 39*d* of the circulation conveyer 5.

In Step S6, the controller 8 performs control to stop the paper conveyance on the switchback circulation route RC upstream of the position of the paper jam. Also, the controller 8 performs control to discharge the sheets P on the switchback circulation route RC downstream of the position of the paper jam and the sheets P on the main conveying route.

When stopping the paper conveyance on the switchback circulation route RC upstream of the position of the paper jam, the controller 8 controls the circulation conveyer 5 such that the sheets P are stopped with an interval therebetween shorter than that during the normal conveyance. Specifically, the controller 8 controls the circulation conveyer 5 such that the sheets P are stopped with the predetermined sheet interval therebetween.

Here, in a case where the direction of the switch 41 is the circulation guiding direction at the time of detection of the paper jam on the switchback circulation route RC, the controller 8 switches the switch 41 to the paper discharge guiding direction once the trailing end of the sheet P passing the switch 41 at the time of detection of the paper jam exits the switch 41. As a result, the sheets P at the circulation conveyer 5 downstream of the position of the paper jam, the external paper feeder 2, and the conveyance printing unit 4 can be discharged.

Thereafter, the controller 8 proceeds to Step S5 and displays the jam error. By this step, the paper jam handling process ends.

Note that when a paper jam occurs on the switchback circulation route RC, the sheet P passing the switch 41 is sometimes the jammed sheet. In this case, the sheet P passing the switch 41 cannot be moved and thus the switch cannot be switched to the paper discharge guiding direction. Thus, the sheets P upstream of the switch 41 cannot be discharged. For this reason, when the above paper jam occurs, the controller 8 stops the paper conveyance by the sections other than the paper discharger 6 and displays the jam error. In this case, sheets P remain at the belt platen 23, and the controller 8 thus lowers the belt platen 23 to the retreat position.

Next, the paper jam handling process will be described using specific examples.

First, as a first specific example, description will be given of one example of the paper jam handling process performed when a paper jam occurs on the main conveying route (external paper feeding route RS1, printing route RP, and paper discharging route RD).

Figure 4:
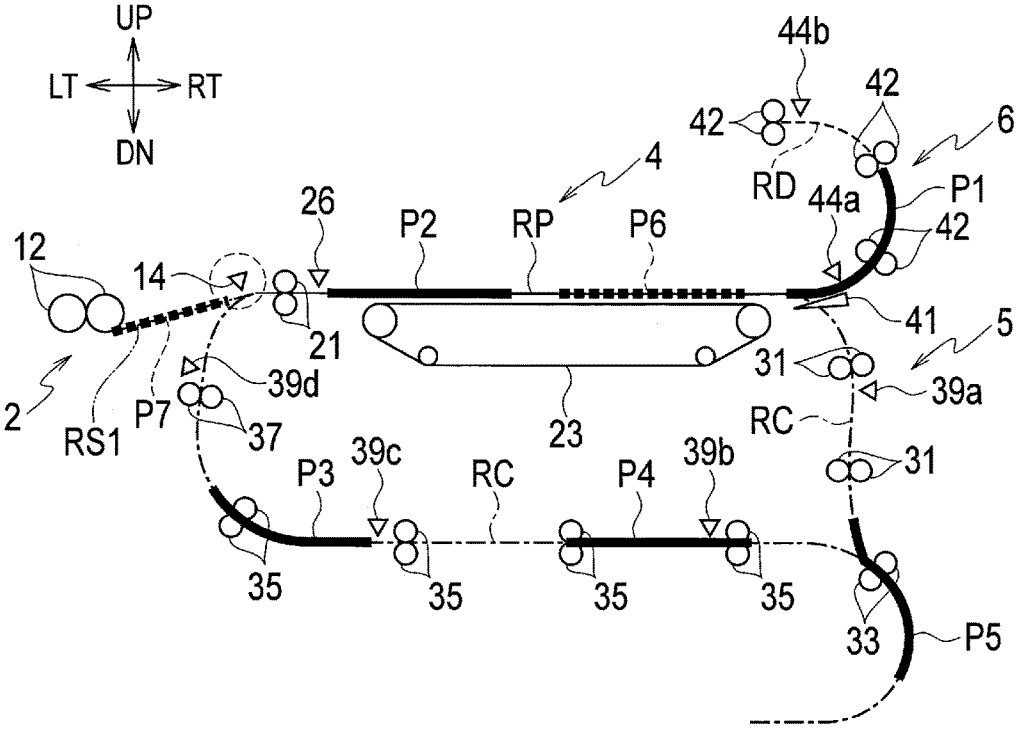
FIG. 4 is a diagram illustrating the positions of sheets at the time of occurrence of a paper jam in a first specific example.

FIG. 4 is a diagram illustrating the positions of sheets at the time of occurrence of the paper jam in the first specific example. In the example in FIG. 4, the sheet sensor 14 detects a jam of a sheet fed from the external paper feeder 2 in the duplex printing.

In FIG. 4, sheets P1 to P5 illustrated by bold solid lines are sheets which have been sequentially fed from the external paper feeder 2, printed on one side, and passed the switch 41 to be guided to the circulation conveyer 5. Among them, the sheet P1 has been printed on both sides and is being guided to the paper discharger 6 by the switch 41 oriented in the paper discharge guiding direction. Sheets P6, P7 illustrated by bold broken lines are sheets which have never passed the switch 41. The sheet P6 is a sheet fed between the sheet P1 and the sheet P2, each of which has been printed on one side. The sheet P7 is a sheet fed between the sheet P2 and the sheet P3, each of which has been printed on one side.

Determining that the paper jam has occurred in the state in FIG. 4, the controller 8 controls the external paper feeder 2 to stop the conveyance of the sheet P7 on the main conveying route upstream of the sheet sensor 14, or the position of the paper jam. Also, the controller 8 controls the belt platen 23 and the paper discharger 6 to discharge the sheets P1, P6, P2 on the main conveying route downstream of the sheet sensor 14.

Further, the controller 8 controls the circulation conveyer 5 to stop the paper conveyance on the switchback circulation route RC. As a result, the sheets P3 to P5 are stopped. Here, the controller 8 controls the circulation conveyer 5 such that the sheets P3 to P5 are stopped with the predetermined sheet interval therebetween.

Figure 5:
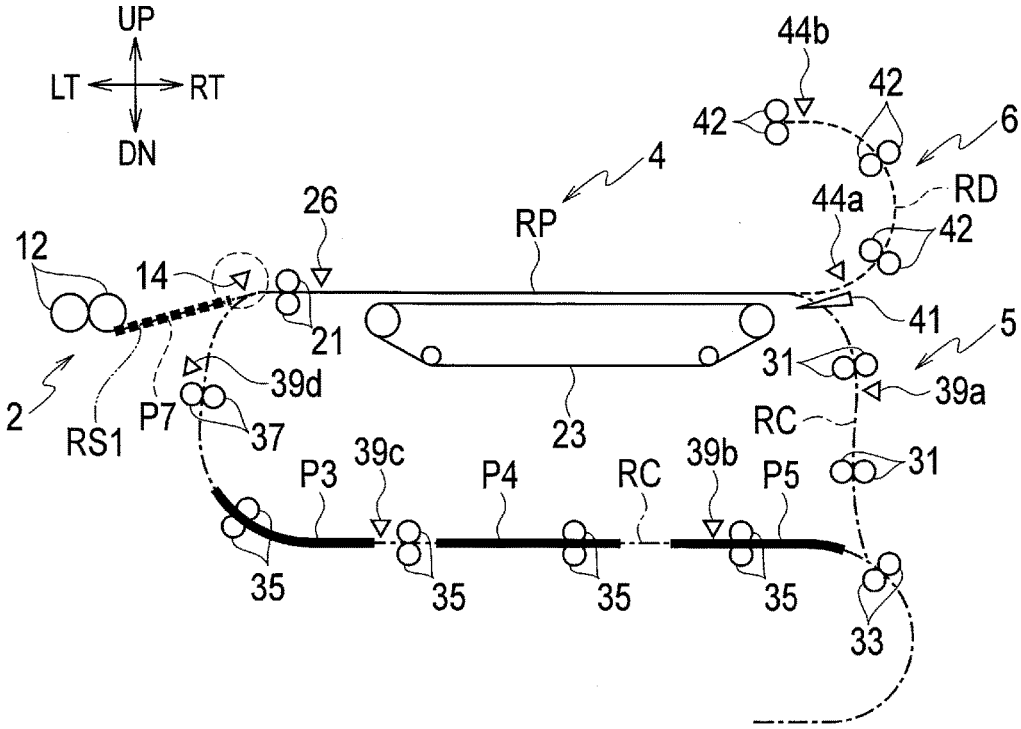
FIG. 5 is a diagram illustrating the positions of the sheets after the paper jam handling process in the first specific example.

As a result, the paper conveyance is stopped in a state illustrated in FIG. 5. Since the sheets P1, P6, P2 are discharged, the remaining sheets are reduced as compared to a case where the paper conveyance is entirely stopped in the state in FIG. 4 at the time of occurrence of the paper jam. Also, since the interval between the sheets P3 to P5 on the switchback circulation route RC is shorter than that during the normal conveyance, the range within which the remaining sheets spread can be narrowed.

Further, since no remaining sheet is on the belt platen 23, the belt platen 23 does not need to be lowered for the jam releasing work. Thus, it is possible to leave a sufficient space for the work of removing the remaining sheets from the horizontal conveying section of the circulation conveyer 5. Furthermore, since the time which would be taken to lower the belt platen 23 can be omitted, it is possible to shorten the time taken to start the jam releasing work.

Next, as a second specific example, description will be given of one example of the paper jam handling process performed when a paper jam occurs on the switchback circulation route RC.

Figure 6:
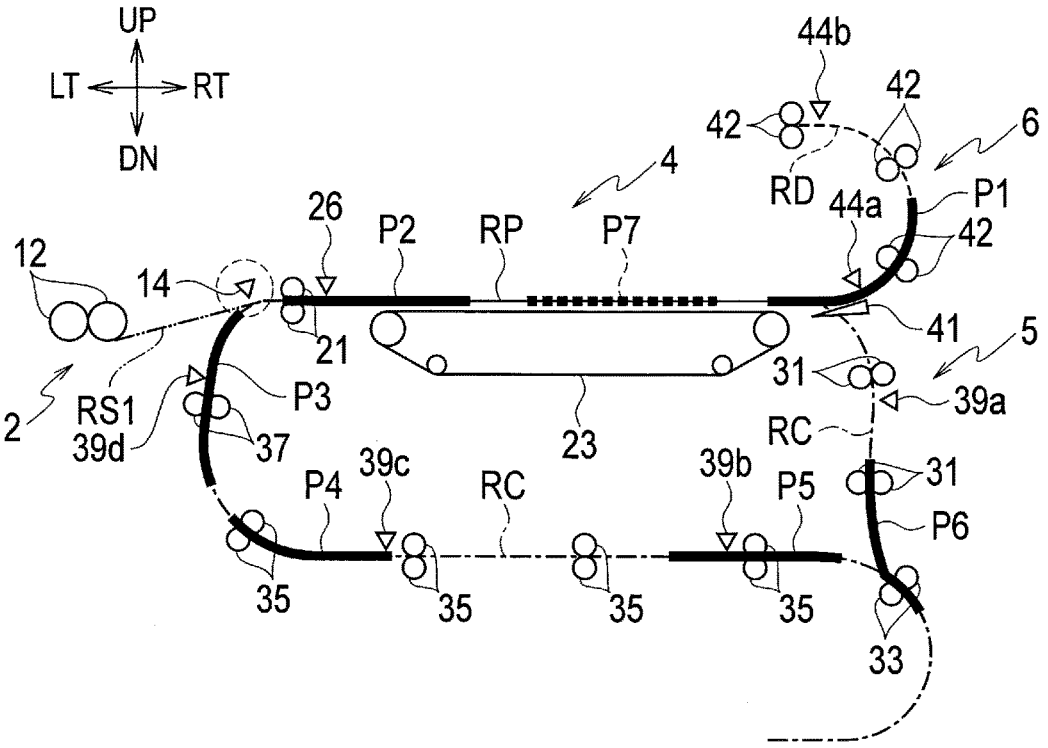
FIG. 6 is a diagram illustrating the positions of sheets at the time of occurrence of a paper jam in a second specific example.

FIG. 6 is a diagram illustrating the positions of sheets at the time of occurrence of the paper jam in the second specific example. In the example in FIG. 6, the sheet sensor 14 detects the paper jam on the switchback circulation route RC during the duplex printing.

Determining that the paper jam has occurred in the state in FIG. 6, the controller 8 controls the circulation conveyer 5 to stop the paper conveyance on the switchback circulation route RC upstream of the sheet sensor 14, or the position of the paper jam. Here, the controller 8 controls the circulation conveyer 5 such that sheets P3 to P6 are stopped with the predetermined sheet interval therebetween.

Specifically, first, the controller 8 controls the circulation conveyer 5 to stop the conveyance of the sheets P3, P4 at the time of detection of the paper jam. Here, the sheet P3 is the jammed sheet and has been stopped before the detection of the paper jam. Also, as mentioned earlier, the jam determining threshold value for the switchback circulation route RC is the sum of the amount of time required to convey a sheet by the predetermined sheet interval and the amount of time required to convey a sheet by the length of a sheet. For this reason, at the time of detection of the paper jam, the interval between the sheet P3 and the sheet P4 is shorter than that during the normal, regular conveyance by the sum of the predetermined sheet interval and the length of a sheet.

Thus, when the conveyance of the sheets P3, P4 is stopped at the time of detection of the paper jam, the interval between the sheet P3 and the sheet P4 is the predetermined sheet interval.

Thereafter, the controller 8 sequentially stops the conveyance of the sheet P5 and the sheet P6 such that the interval between the sheet P4 and the sheet P5 and the interval between the sheet P5 and the sheet P6 can each be the predetermined sheet interval.

Meanwhile, when determining that the paper jam has occurred in the state in FIG. 6, the controller 8 controls the registration rollers 21, the belt platen 23, and the paper discharger 6 to discharge sheets P1, P7, P2 on the main conveying route.

Figure 7:
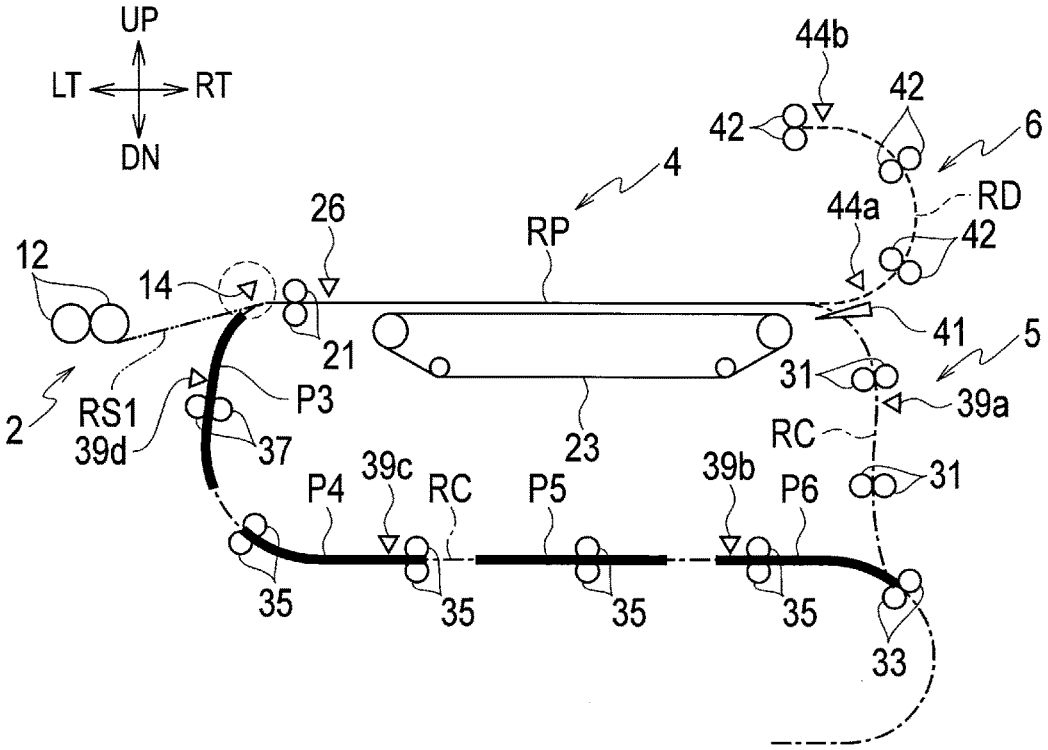
FIG. 7 is a diagram illustrating the positions of the sheets after the paper jam handling process in the second specific example.

As a result, the paper conveyance is stopped in a state illustrated in FIG. 7. Since the sheets P1, P7, P2 are discharged, the remaining sheets are reduced as compared to a case where the paper conveyance is entirely stopped in the state in FIG. 6 at the time of occurrence of the paper jam. Also, since the interval between the sheets P3 to P6 on the switchback circulation route RC is shorter than that during the normal conveyance, the range within which the remaining sheets spread is narrowed. Further, since no remaining sheet is on the belt platen 23, the belt platen 23 does not need to be lowered for the jam releasing work.

Note that in the example in FIG. 6, the position of the paper jam is at the most downstream section of the switchback circulation route RC; hence, when the paper jam is detected, sheets P are not present on the switchback circulation route RC downstream of the position of the paper jam. When a paper jam is detected, however, sheets P may be present on the switchback circulation route RC downstream of the position of the paper jam. In this case, the controller 8 performs control to discharge those sheets P along with the sheets P on the main conveying route.

As described above, in the printer 1, when a paper jam occurs on the main conveying route (external paper feeding route RS1, printing route RP, and paper discharging route RD), the controller 8 controls the external paper feeder 2, the conveyance printing unit 4, the paper discharger 6, and the circulation conveyer 5 to stop the paper conveyance on the main conveying route upstream of the position of the paper jam and discharge the sheets P downstream of the position, and to stop the paper conveyance on the switchback circulation route RC. When a paper jam occurs on the switchback circulation route RC, the controller 8 controls the external paper feeder 2, the conveyance printing unit 4, the paper discharger 6, and the circulation conveyer 5 to stop the paper conveyance on the switchback circulation route RC upstream of the position of the paper jam, and to discharge the sheets P on the switchback circulation route RC downstream of the position of the paper jam and the sheets P on the main conveying route.

In this way, the sheets remaining after the occurrence of a paper jam can be reduced. As a result, the amount of paper jam releasing work can be reduced.

Also, the occurrence of a situation where sheets P remain at the belt platen 23 can be reduced. Specifically, sheets P do not remain at the belt platen 23 unless a paper jam occurs at the paper discharger 6. With no remaining sheets at the belt platen 23, the belt platen 23 does not need to be lowered for the jam releasing work. Thus, it is possible to leave a sufficient space for the work of removing the remaining sheets from the horizontal conveying section of the circulation conveyer 5. Also, since the time which would be taken to lower the belt platen 23 can be omitted, it is possible to shorten the time taken to start the jam releasing work. As a result, convenience during jam release is improved.

Also, in the printer 1, when stopping the paper conveyance on the switchback circulation route RC due to the occurrence of a paper jam, the controller 8 controls the circulation conveyer 5 such that the sheets P are stopped with an interval therebetween shorter than that during the normal conveyance. In this way, the range on the switchback circulation route RC within which the remaining sheets spread can be narrowed. As a result, the amount of paper jam releasing work can be reduced further.

Further, in the printer 1, the jam determining threshold value for the switchback circulation route RC, on which sheets P are conveyed with a longer interval therebetween than on the main conveying route, is set to be greater than the jam determining threshold value for the main conveying route. In this way, when a paper jam occurs on the switchback circulation route RC, it is possible to lengthen the time for which the paper conveyance can be continued. As a result, it is possible to shorten the down time due to the occurrence of the paper jam. Also, it is possible to reduce the stoppage of printing operation due to a paper jam which may possibly be solved by continuing the paper conveyance.

The above embodiment has described the paper jam handling process performed in the situation where sheet are fed from the external paper feeder 2. Note, however, that a similar paper jam handling process can also be performed in a situation where sheets are fed from the internal paper feeder 3. In doing so, the switchback circulation route RC between the downstream end of the internal paper feeding route RS2 and the upstream end of the printing route RP should be considered a part of the main conveying route. In this case, a route formed of the internal paper feeding route RS2, the switchback circulation route RC between the downstream end of the internal paper feeding route RS2 and the upstream end of the printing route RP, the printing route RP, and the paper discharging route RD corresponds to the main conveying route. Further, the internal paper feeder 3, the vertical conveying rollers 37, the conveyance printing unit 4, and the paper discharger 6 constitute the main conveyer. Furthermore, the switchback circulation route RC between the downstream end of the printing route RP and the downstream end of the internal paper feeding route RS2 corresponds to the circulation conveying route.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printer comprising:

a main conveyer including a paper feeder configured to feed a sheet in a conveying direction, a printing conveyer provided downstream of the paper feeder in the conveying direction and configured to convey the sheet in the conveying direction, an image former configured to form an image on the sheet being conveyed by the printing conveyer, and a paper discharger provided downstream of the printing conveyer in the conveying direction and configured to discharge the sheet, the main conveyer being configured to convey the sheet along a main conveying route extending from the paper feeder through the printing conveyer to the paper discharger;

a circulation conveyer configured to convey the sheet along a circulation conveying route branched off from the main conveying route at a branch point between the printing conveyer and the paper discharger, in the conveying direction and joining the main conveying route at a point upstream of the printing conveyer in the conveying direction; and a controller configured to control the main conveyer and the circulation conveyer, wherein the controller upon occurrence of a paper jam on the main conveying route, controls the main conveyer and the paper discharger to stop paper conveyance at a section of the main conveying route upstream of a position of the paper jam in the conveying direction and to discharge sheets at a section of the main conveying route downstream of the position of the paper jam in the conveying direction, and controls the circulation conveyer to stop paper conveyance at the circulation conveying route, upon occurrence of a paper jam on the circulation conveying route, controls the circulation conveyer to stop paper conveyance at a section of the circulation conveying route upstream of a position of the paper jam, and controls the circulation conveyer, the main conveyer, and the paper discharger to discharge sheets at a section of the circulation conveying route downstream of the position of the paper jam and at the main conveying route, and when stopping the paper conveyance at the section of the circulation conveying route upstream of the position of the paper jam upon occurrence of the paper jam on the circulation conveying route, the controller controls the circulation conveyer to stop the sheets with an interval between the sheets shorter than an interval between sheets during normal conveyance.

2. A printer comprising:

a main conveyer including a paper feeder configured to feed a sheet in a conveying direction, a printing conveyer provided downstream of the paper feeder in the conveying direction and configured to convey the sheet in the conveying direction, an image former configured to form an image on the sheet being conveyed by the printing conveyer, and a paper discharger provided downstream of the printing conveyer in the conveying direction and configured to discharge the sheet, the main conveyer being configured to convey the sheet along a main conveying route extending from the paper feeder through the printing conveyer to the paper discharger;

a circulation conveyer configured to convey the sheet along a circulation conveying route branched off from the main conveying route at a branch point between the printing conveyer and the paper discharger, in the conveying direction and joining the main conveying route at a point upstream of the printing conveyer, in the conveying direction; and a controller configured to control the main conveyer and the circulation conveyer, a first sheet sensor arranged along the main conveying route; and a second sheet sensor arranged along the circulation conveying route, wherein the controller upon occurrence of a paper jam on the main conveying route, controls the main conveyer and the paper discharger to stop paper conveyance at a section of the main conveying route upstream of a position of the paper jam in the conveying direction and to discharge sheets at a section of the main conveying route downstream of the position of the paper jam in the conveying direction, and controls the circulation conveyer to stop paper conveyance at the circulation conveying route, upon occurrence of a paper jam on the circulation conveying route, controls the circulation conveyer to stop paper conveyance at a section of the circulation conveying route upstream of a position of the paper jam, and controls the circulation conveyer, the main conveyer, and the paper discharger to discharge sheets at a section of the circulation conveying route downstream of the position of the paper jam and at the main conveying route, drives the circulation conveyer to convey sheets at the circulation conveying route with an interval between the sheets longer than an interval between sheets at a section of the main conveying route upstream of the branch point in the conveying direction, determines an occurrence of a paper jam in at least one of a case where a delay time of a timing of sheet detection by the first sheet sensor from a theoretical value for the timing of sheet detection by the first sheet sensor is greater than or equal to a first jam determining threshold value or a case where a delay time of a timing of sheet detection by the second sheet sensor from a theoretical value for the timing of sheet detection by the second sheet sensor is greater than or equal to a second jam determining threshold value, and wherein the second jam determining threshold value is greater than the first jam determining threshold value.

3. The printer according to claim 1, further comprising:

a first sheet sensor arranged along the main conveying route; and a second sheet sensor arranged along the circulation conveying route, wherein the controller drives the circulation conveyer to convey sheets at the circulation conveying route with an interval between the sheets longer than an interval between sheets at a section of the main conveying route upstream of the branch point in the conveying direction, and determines an occurrence of a paper jam in at least one of a case where a delay time of a timing of sheet detection by the first sheet sensor from a theoretical value for the timing of sheet detection by the first sheet sensor is greater than or equal to a first jam determining threshold value or a case where a delay time of a timing of sheet detection by the second sheet sensor from a theoretical value for the timing of sheet detection by the second sheet sensor is greater than or equal to a second jam determining threshold value, and wherein the second jam determining threshold value is greater than the first jam determining threshold value.

4. The printer according to claim 1, further comprising at least one main conveyor paper sensor positioned along the main conveyor and at least one circulation conveyor paper sensor positioned along the circulation conveyor, the controller determining whether or not a paper jam has occurred based on timing of sheet detection by the at least one of the at least one main conveyor paper sensor and at least one of the circulation conveyor paper sensor.

5. The printer according to claim 1, wherein a timing interval of feeding sheets when the circulation conveyor is utilized is twice as long as a timing interval when the circulation conveyor is not utilized.

6. The printer according to claim 1, further comprising at least one main conveyor paper sensor positioned along the main conveyor and at least one circulation conveyor paper sensor positioned along the circulation conveyor, the controller determining that a paper jam has occurred when a delay in detection of a sheet by at least one of the at least one main conveyor paper sensor and the at least one circulation conveyor paper sensor is equal to or greater than a predetermined threshold value.

* * * * *